US005293134A

United States Patent [19]

Holmes et al.

[11] Patent Number: 5,293,134

[45] Date of Patent: Mar. 8, 1994

[54] TANDEM ACCELERATOR

[75] Inventors: Andrew J. T. Holmes, Marcham; Gary Proudfoot, Wantage, both of United Kingdom

[73] Assignee: United Kingdom Atomic Energy Authority, Didcot, United Kingdom

[21] Appl. No.: 848,700

[22] Filed: Mar. 9, 1992

[30] Foreign Application Priority Data

Mar. 13, 1991 [GB] United Kingdom ..... 9105368.6

[51] Int. Cl.[5] ..... H05H 5/06

[52] U.S. Cl. ..... 328/227

[58] Field of Search ..... 313/360.1, 362.1; 328/233, 227

[56] References Cited

U.S. PATENT DOCUMENTS

| | | | |
|---|---|---|---|
| 2,272,374 | 2/1942 | Kallmann et al. | 313/360.1 |
| 3,209,269 | 9/1965 | Julian et al. | 328/233 |
| 3,786,359 | 1/1974 | King | 328/233 |
| 3,793,550 | 2/1974 | Thompson, Jr. | 313/360.1 |
| 3,794,927 | 2/1974 | Fleischer et al. | 328/233 |

*Primary Examiner*—Sandra L. O'Shea

*Attorney, Agent, or Firm*—William R. Hinds

[57] ABSTRACT

A tandem accelerator for producing a beam of positively charged particles in which the positive ion producing and accelerating region of the apparatus is operated under vacuum conditions.

1 Claim, 1 Drawing Sheet

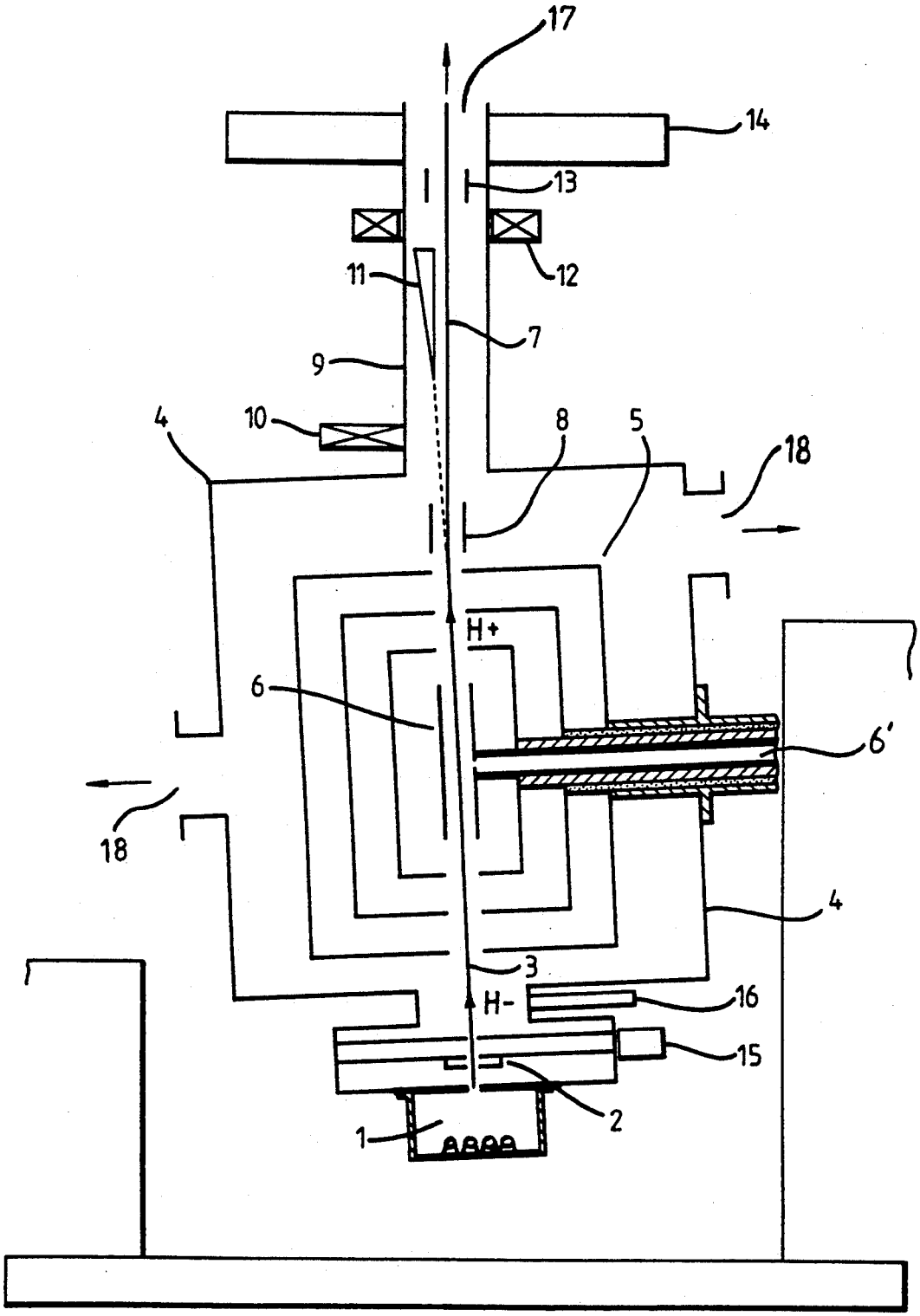
17
14
13
12
11
7
9
10
4
8
5
18
H+
6
6'
18
4
3
H-
16
15
2
1

TANDEM ACCELERATOR

BACKGROUND OF THE INVENTION

The present invention relates to particle accelerators of the type known as tandem accelerators.

Tandem accelerators are devices for producing beams of positively charged particles with high energies of the order of 10 MeV. The basic design of such devices is very simple. A negative ion beam, for example $H^-$ or $O^-$ is accelerated to a central positively biased electrode at which point a stripper foil removes two or more electrons from the negatively charged ions to produce a positively charged ion beam which is subsequently accelerated to the ground plane by the same potential as that used to produce the positive ions. In order to achieve ion energies of about 10 MeV it is necessary to apply potentials of about 5 MeV to the central electrode and so it is necessary to isolate the central electrode from ground in such a manner as to be capable of withstanding the potential gradients produced. To achieve this in air requires the separation of the high and low potential planes by distances of many metres.

In an attempt to reduce the size of tandem accelerators, designers of tandem accelerators therefore conventionally fill the accelerators with a gas such as sulphur hexafluoride, which has considerably better breakdown characteristics than those of air. However, even so, the distance required to hold-off even 1 MeV is about 2 metres at one bar. Also, sulphur hexafluoride is potentially dangerous and very expensive, both of which characteristics lead to considerable engineering complexity in the design of tandem accelerators. Furthermore, the ion beam has to be isolated from the rest of the apparatus by means of cells and windows which are thin enough to be penetrated by the ion beams but strong enough to withstand the pressure gradient between the near vacuum inside the cells, required to maintain the ion beams, and the pressurised environment necessary to provide the electrical isolation of the positively charged central eletrode. Both these windows and the stripper foils are susceptible to damage, which requires taking the accelerator out of service to rectify, which both is inconvenient and costly as the equipment has to be virtually dismantled for this to be done.

BRIEF SUMMARY OF INVENTION

The present invention overcomes the above problems and also produces a much more compact design of tandem accelerator by inverting normal practice and operating under vacuum conditions. By so doing, potential gradients an order of magnitude higher than those achievable with sulphur hexafluoride can be used. Thus the overall dimensions of the accelerator can be reduce correspondingly. Other advantages possessed by the invention are that the higher electric fields which can be used allow higher ion beam currents to be propagated, with good beam stability and transmission optics, than are possible with conventional tandem accelerators.

According to the present invention there is provided a tandem accelerator ion beam source for producing a beam of positive ions having energies greater than 1 MeV and a beam current greater than 10 mA, comprising a volume ion source for producing a beam of negative ions having an energy of the order of tens of kilowatts and a beam current of at least 10 mA, a windowless ion stripper cell arranged to convert the negative ions to positive ions, means for supplying an electron stripping gas to the stripper cell, a plurality of electric stress shields surrounding the ion stripper cell and arranged to produce an electric field of about 20 kV/cm in the region of the ion stripper cell, means for removing uncharged species from the beams of positive ions, means for controlling the direction of the beam of positive ions, a vacuum envelope enclosing the ion beam path within the tandem generator, the electric stress shields and the windowless tripping cell, and a vacuum system for producing a dynamic vacuum of at least $10^{-5}$ torr within the vacuum envelope. A suitable stripping gas is argon, particularly if $H^+$ ions are to be produced by the particle accelerator.

BRIEF DESCRIPTION OF DRAWING

The invention will now be described, by way of example, with reference to the accompanying drawing which is a diagrammatic representation of an embodiment of the invention adapted to produce a beam of $H^+$ ions with an energy of approximately 1.8 MeV.

DETAILED DESCRIPTION OF INVENTION

Referring to the drawing, a tandem accelerator embodying the invention consists of a plasma source of $H^-$ ions 1 which has associated accelerating electrodes 2, and produces a beam 3 of $H^-$ ions which have an energy of between 30 and 50 keV, as required, and a beam current of some 15 mA. The ion beam 3 passes into a main body portion 4 of the accelerator where it passes through a series 5 of integrated accelerating and electric stress shields and a windowless gas stripper cell 6 by which it is converted into a beam 7 of $H^+$ ions. Gas is supplied to the stripper cell 6 by means of an inlet port 6'. A suitable stripping gas is Argon. The $H^+$ ion beam 7 passes again through the accelerating and electric stress shields 5 and leaves the main body portion 4 of the accelerator via a set of electrostatic steering electrodes 8 and an exit channel 9.

The electric field stress within the main body portion 4 of the accelerator is controlled at about 20 kV/cm by means of the segmented stress shields 5 which grade the potential within the main body portion 4 of the accelerator from ground potential at the wall of the main body portion 4 of the accelerator to about 900 kV at the gas stripper cell 6. Because of the change in the ionisation state of the hydrogen from negative to positive, the $H^+$ ion beam 7 leaves the main body portion 4 of the accelerator with an energy of 1.8 keV.

Associated with the exit channel 9 are a retractable beam dump 10, a neutral beam dump 11 positioned to intercept any neutral hydrogen atoms in the ion beam 7 which are unaffected by the beam steering electrodes 8, a beam current monitor which includes a focusing electromagnet 12, a set of 2-axis electrostatic fine steering electrodes 13 and beam diagnostic equipment 14. Associated with the ion source 1 is a vacuum pump 15 and a fast-acting gate valve 16 by means of which it can be isolated from the main body portion 4 of the accelerator.

The whole envelope of the accelerator from the ion source 1 to the exit aperture 17 of the exit channel 9 forms a single vacuum enclosure which is maintained at a dynamic vacuum of about $10^{-5}$ torr by means of suitable vacuum pumps connected to ports 18 in the wall of the main body portion 4 of the accelerator.

The device described above is adapted to produce $H^+$ ions. However, it is perfectly capable of producing ions of other materials such as oxygen or chlorine. Some consequential changes may have to be made to the ion source 1 or the stripping gas in such a case, but the fundamental principle of the apparatus remains the same.

We claim:

1. A tandem accelerator ion beam source for producing a beam of positive ions having energies greater than 1 MeV and a beam current greater than 10 mA, comprising a volume ion source for producing a beam of negative ions having an energy of the order of tens of kilowatts and a beam current of at least 10 mA, a windowless ion stripper cell arranged to convert the negative ions to positive ions, means for supplying an electron stripping gas to the stripper cell, a plurality of electric stress shields surrounds the ion stripper cell and arranged to produce an electric field of about 20 kV/cm in the region of the ion stripper cell, means for removing uncharged species from the beams of positive ions, means for controlling the direction of the beam of positive ions, a vacuum envelope enclosing the ion beam path within the tandem generator, the electric stress shields and the windowless stripping cell, and a vacuum system for producing a dynamic vacuum of at least $10^{-5}$ torr within the vacuum envelope.

* * * * *